United States Patent [19]

Haag

[11] Patent Number: 4,731,000

[45] Date of Patent: Mar. 15, 1988

[54] SPIRAL COMPRESSOR WITH GUIDES FOR FIXING THE SPIRAL ELEMENT AGAINST ROTATION

[75] Inventor: Gottlob Haag, Markgröningen, Fed. Rep. of Germany

[73] Assignee: Robert Bosch GmbH, Stuttgart, Fed. Rep. of Germany

[21] Appl. No.: 936,703

[22] Filed: Dec. 1, 1986

[30] Foreign Application Priority Data

Feb. 11, 1986 [DE] Fed. Rep. of Germany ..... 3604235

[51] Int. Cl.[4] ..... F04C 18/04

[52] U.S. Cl. ..... 418/55; 418/56; 418/57

[58] Field of Search ..... 418/55, 57, 59, 56

[56] References Cited

U.S. PATENT DOCUMENTS

| | | | |
|---|---|---|---|
| 3,314,370 | 4/1967 | Jacobs | 418/59 |
| 3,817,664 | 6/1974 | Bennett et al. | 418/55 |
| 4,314,796 | 2/1982 | Terauchi | 418/57 |
| 4,475,874 | 10/1984 | Sato | 418/57 |
| 4,609,334 | 9/1986 | Muir et al. | 418/57 |

FOREIGN PATENT DOCUMENTS

| | | | |
|---|---|---|---|
| 55-46081 | 3/1980 | Japan | 418/55 |
| 57-26203 | 2/1982 | Japan | 418/55 |
| 58-135302 | 8/1983 | Japan | 418/55 |
| 60-182382 | 9/1985 | Japan | 418/55 |

OTHER PUBLICATIONS

Copy of MTZ Motortechnische Zeitschrift, 46 (1985), 9: "VW's Mechanical Driven Super Charger", by K.-D. Emmenthal, C. Müller and O. Schäfer.

*Primary Examiner*—John J. Vrablik
*Attorney, Agent, or Firm*—Michael J. Striker

[57] ABSTRACT

A spiral compressor has a two-part housing, a displacement element positioned between two parts of the housing and having a spiral wall extending into a spiral chamber, formed in one of the housing parts, so that two working chambers are defined in the spiral chamber. The displacement element has an eccentric which is mounted to the end of a drive shaft. The displacement element is provided with a device for securing it against rotation. The securing device includes at least three guides positioned on the displacement element and circumferentially spaced from each other. Each guide has a ball bearing engaged in a plastic sleeve located in a pocket bore of the displacement element and supported on a bolt screwed to the second one of the housing parts. Thereby the displacement element is slightly pre-stressed in each position of the eccentric and thus secured against rotation.

9 Claims, 2 Drawing Figures

SPIRAL COMPRESSOR WITH GUIDES FOR FIXING THE SPIRAL ELEMENT AGAINST ROTATION

BACKGROUND OF THE INVENTION

The present invention relates to a spiral compressor of the type having two housing portions one of which has a spiral chamber and a displacement member having a spiral wall extended in the spiral chamber.

Spiral compressors of the foregoing type have been utilized as compressors for Otto and Diesel motors because they are less noisy and less succeptible to troubles than vane-type compressors. While dry-operated vane-type compressors are utilizable only at overpressure up to 0.3 bar because their wear is too high and efficiency is too low the spiral compressors can be used at higher pressure up to 0.7 bar and with substantially better efficiency.

In the spiral compressors of the type under discussion the displacement element must be fixed so that during the rotation of an eccentric of the drive shaft provided in such spiral compressors the displacement element would not be taken along by the eccentric.

In conventional spiral compressors of this type (MTZ 46/1985/9, pages 323, 324), the movement of the displacement element is controlled by an auxiliary shaft driven by toothed belts. This known arrangement corresponds to a two-throw crankshaft parallelogram. To compensate for measurement deviations due to manufacture tolerances and various thermal expansions due to heating of the housing structural components, displacement element and drive, the eccentric bearing of the auxiliary shaft is elastically embedded in the displacement element by a rubber element with predetermined characteristics. The bearings of the auxiliary shaft are grease-lubricated whereas the bearings of the drive shaft are lubricated with oil which is supplied from the oil circuit of the Otto or Diesel motor. This conventional spiral compressor is however expensive in structure and can not operate without a continual lubrication of the bearings with oil. It is not suitable for dry-operations.

Also known is a spiral compressor which has a device for fixing the displacement element against rotation, realized by balls which act similarly to the axial ball bearing and can be held in the bearing rings connected with the displacement element and two housing portions.

In a spiral compressor or pump shown in U.S. Pat. No. 3,817,664 the fixing device of the displacement member against rotation is formed by an Oldham-ring. There the lubrication is also indispensable.

SUMMARY OF THE INVENTION

It is an object of the present invention to provide an improved spiral compressor.

It is another object of the invention to provide a spiral compressor in which the lubrication would not be necessary; thus the compressor could be used as a dry-operating spiral compressor.

These and other objects of this invention are attained by a spiral compressor, comprising a first housing portion having a spiral chamber; a second housing portion closing said first portion; a displacement element displaceably held between said first and second portion, said element having a spiral wall extending into said spiral chamber and enclosing with said spiral chamber an outer suction chamber and an inner high pressure chamber; a drive shaft; an eccentric carried on one end of said shaft and supported in said displacement element; and means for fixing said element against rotation, said means including at least three guides spaced from each other along a periphery of said element at equal angles and arranged in a plane perpendicular to said drive shaft, said element having pocket bores, each guide including a guide bearing positioned in a respective pocket bore of said element and extending into and being held in a bore of said second housing portion; plastic sleeves each inserted in a respective pocket bore under slight pre-stressing with interposition of two rubber elastic O-rings spaced from each other, an inner diameter of said plastic sleeve being smaller than a sum of the diameter of said guide bearing and the diameter of said eccentric.

Due to the present invention the displacement element is slightly prestressed in each position of the eccentric and therefore is secured against rotation. Tolerances and thermal expansions of various structural components of the housing, displacement element and drive are compensated for. Due to playfree arrangement in the fixing means the compressor runs smoothly even at high speeds. The spiral compressor according to the invention is suitable for use in particular as a dry-operated air pump for soot burning in Diesel motors.

Four said guides may be provided along the periphery of said displacement element.

The spiral compressor may further include an eccentric bearing for supporting said eccentric in said displacement element, said element having a pocket bore, at least one rubber elastic O-ring being positioned in said element for supporting said eccentric bearing at a cylindrical wall of said pocket bore. By elastic embedding of the eccentric bearing in the displacement element the aforementioned properties of the spiral compressor are further improved.

Each guide bearing may be formed as a ball bearing having an inner ring, an outer ring and balls running therebetween, and a bearing bolt supporting said inner ring thereon, said outer ring being in engagement with an inner wall of said plastic sleeve, said bearing bolts of said guide bearings being screwed in said second housing portion and being positioned at an equal radial distance from a central axis of said second housing portion.

It is advantageous that the displacement element may have a back side facing said second housing portion and coated with a plastic layer, preferably PTFE foil glued to said back side. Due to this feature friction during the dry operation, upon the contact of the back side of the displacement element with the respective surface of the second housing portion can be minimal.

The displacement element may have an axial passage which connects said inner high pressure chamber with an air play formed between said second housing portion and the back side of said displacement element which faces said second housing portion. Due to this axial passage the size of which can be precisely predetermined, a pressure-compensation is established between the high pressure chamber and the suction chamber by a play between the back side of the displacement element and the second housing portion. Thus a small increase in the output of the spiral compressor during the dry operation is obtained.

According to yet another feature of this invention a sealing means between the drive shaft and the second housing portion may be provided, which means comprises a slide ring device including a plastic ring mounted on said drive shaft with interposition of an O-ring, a safety ring positioned on said drive shaft, and a disc spring which presses said plastic ring to said The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
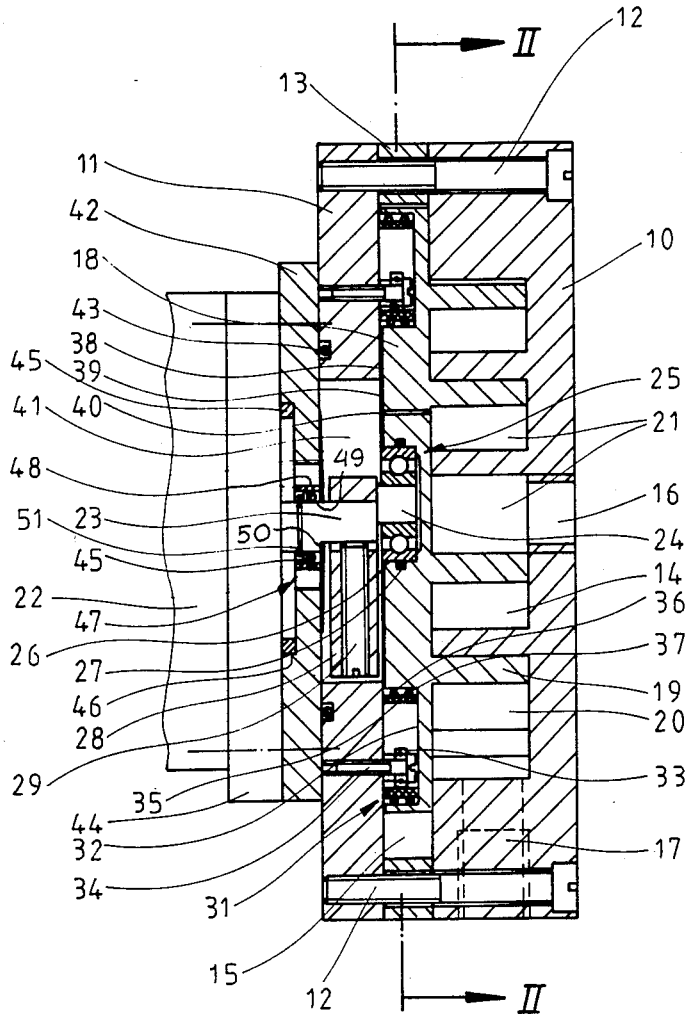
FIG. 1 is an axial sectional view of a spiral compressor flanged to an electric motor.

Referring now to the drawings in detail it will be seen that the spiral compressor according to this invention includes a housing comprised of a first housing portion 10 which is closed by a second housing portion 11 which is a cover. The first and second portions 10 and 11 are spaced from each other by a spacer ring 13 and are connected to each other by threaded bolts 12 also extending through the spacer ring 13.

The first housing portion 10 has in the known fashion a spiral chamber 14 which is open at one side in the axial direction. A central discharge opening 16 axially extending through the first housing portion 10 opens into said spiral chamber, on the one hand, and, a radially projecting suction opening 17 in the form of the housing bore and also formed in the first housing portion 10, opens into the spiral chamber 14, on the other hand.

In an intermediate space or chamber 15 formed by the spacer ring 13 between the first and second housing portions 10 and 11, is displaceably positioned a displacement element 18 which has an axially projecting spiral wall 19 which extends into the spiral chamber 14. The spiral wall 19 and the spiral chamber 14 form together two working chambers which are sealed from each other, that are an external suction chamber 20 and an internal high pressure chamber 21. Upon operation of the displacement element 18 air is sucked via suction opening 17 into working chambers 20, 21 where it is compressed and then is discharged via the discharge opening 16.

Figure 2:
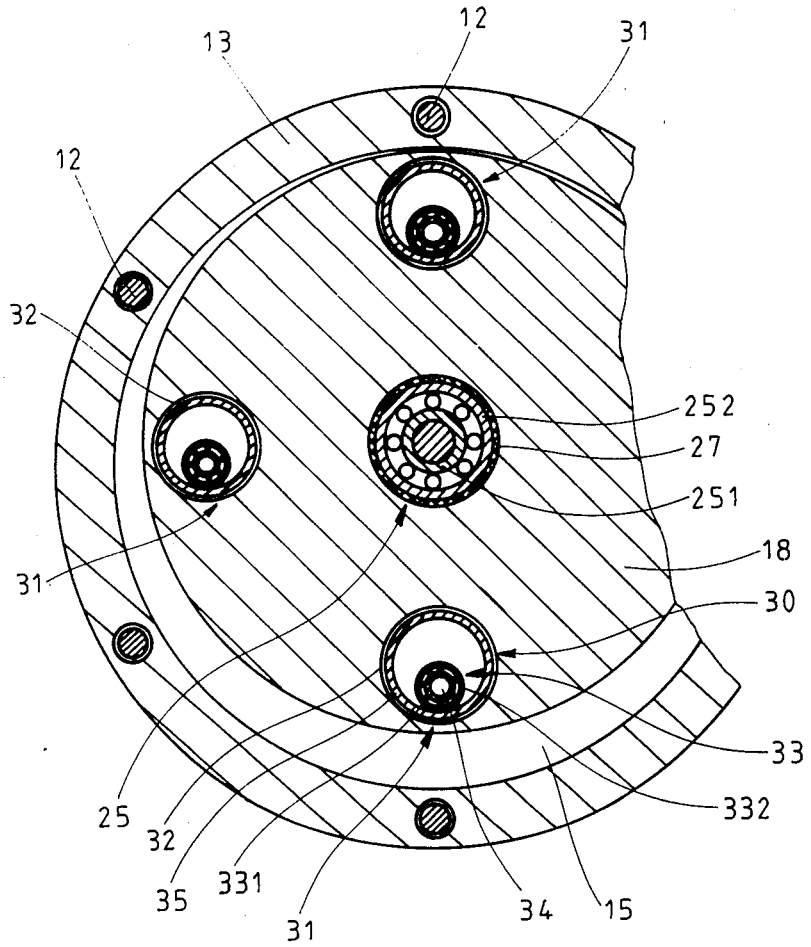
FIG. 2 is a sectional view taken along line II—II of FIG. 1.

A drive shaft 23 driven by an electric motor 22 is provided for driving the displacement element 18. The drive shaft 23 carries at one end thereof an eccentric 24 which is supported by means of a ball bearing 25 in a pocket bore 26 of the displacement element 18. The ball bearing 25 has an inner bearing ring 251 (FIG. 2) which is situated on the eccentric 24 and an outer ring 252 which is clamped in the pocket bore 26 by a rubber ring 27. Eccentric 24 is secured to a crank or connecting rod 28 and is preferably made of one piece with the latter. Crank 28 is in turn mounted on the drive shaft 23 of the electric motor 22 and is rotation-fixed to that shaft by a radial screw 29.

In order to secure the displacement element 18 against rotation movement during the rotation of the eccentric 24 a fixing device 30 is provided. This fixing device or arrangement includes four guides 31 offset from each other by angle 90° along the periphery of the displacement element 18.

Each guide 31 includes a pocket bore 32 and a guide bearing 33 which is inserted in that pocket bore. All pocket bores 32 are positioned at the same distance from the central axis of the displacement element 18, which central axis coincides with the axis of eccentric 24 and the axis of ball bearing 25. The guide bearings 33 are formed as ball bearings the inner ring 331 of which is situated on a bearing bolt 34 which is screwed in the second housing portion 11. The bearing bolts or pins 34 are positioned at the same radial distance from the central axis of the second housing portion 11 which is in alignment with the central axis of the drive shaft 23. The outer ring 332 of each guide bearing 33 is in engagement with a plastic sleeve 35 which is inserted in the pocket bore 32 with the interposition of two rubber-elastic O-rings 36, 37 inserted under slight prestressing. The inner diameter of the plastic sleeve 35 is insignificantly smaller than the sum of the diameter of the bearing outer ring 332 of the guide bearing 33 and the outer diameter of the eccentric 24. Due to such a structure of the plastic sleeve 35 the displacement element 18 is slightly prestressed relative to the crank drive, which is comprised of the drive shaft 23 and eccentric 24, in each position by O-rings 36, 37 and the rubber ring 27 of the eccentric ball bearing 25. Thereby the displacement element 18 is supported play-free so that various tolerances and thermal expansions are compensated for and the device operates at high speeds relatively smoothly.

A small air gap 38 is normally existent between the back end face of the displacement element 18, which faces the second housing portion 11, and the end face of this housing portion. In order to maintain, at a dry running a friction, due to contact between the end face of the housing portion 11 and the back end face of the displacement element, as low as possible the back end face of the displacement element 18 is coated with PTFE foil 39 secured thereto,for example by glue.

An axial passage 40 is provided in the displacement element 18, which passage extends through the displacement element and opens into the high pressure chamber 21 at the one side and into a pressure-compensating chamber 41 at the other side. The pressure-compensating chamber 41 is formed by a coaxial through bore in the second housing portion 11, in which crank 28 rotates. The pressure-compensating chamber 41 is connected with the suction chamber 20 via the air gap 38. By this relatively precisely-measured axial passage 40, is established a pressure compensation condition between the high pressure chamber 21, pressure-compensating chamber 41 and suction chamber 20, which would cause a small power consumption during the dry operation of the spiral compressor.

The above described connection between the high pressure chamber 21 and the pressure-compensating chamber 41 requires the sealing of the second housing portion 11. Therefore a sealing ring 43 is provided between the second housing portion 11 and an intermediate disc 42 which closes the pressure-compensating chambe 41 in the second housing portion 11. The intermediate disc 42 is together with a flange 44 screwed to the housing of the electric motor 22 by bolts shown by dash-dotted lines. The front flange 44 is placed against a centering collar 45 which is overlapped by a flat cylindrical recess 46 formed in the intermediate disc 42. In order to seal the pressure-compensating chamber and the drive shaft 23 a slide ring-shaped sealing 47 is provided. This sealing is comprised of a plastic ring 48 which is situated on the drive shaft 23 with the interposition of an O-ring 49 and is pressed by a disc spring 50 against a safety ring 51 secured to the drive shaft 23.

It will be understood that each of the elements described above, or two or more together, may also find a useful application in other types of spiral compressors differing from the types described above.

While the invention has been illustrated and described as embodied in a spiral compressor, it is not intended to be limited to the details shown, since various modifications and structural changes may be made without departing in any way from the spirit of the present invention.

With further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A spiral compressor, comprising a first housing portion having a spiral chamber; a second housing portion closing said first portion; a displacement element displaceably supported between said first and second portions, said element having a spiral wall extending into said spiral chamber and enclosing with said spiral chamber an outer suction chamber and an inner high pressure chamber; a drive shaft; an eccentric carried on one end of said shaft and supported in said displacement element; and means for fixing said element against rotation, said means including at least three guides (30) spaced from each other along a periphery of said element at equal angles and arranged in a plane perpendicular to said drive shaft, said element having pocket bores (32); each guide (31) including a guide bearing (33) positioned in a respective pocket bore of said element and extending into and being fastened to said second housing portion, a plastic sleeve (35) inserted in a respective pocket bore under slight prestressing with interposition of two rubber elastic O-rings spaced from each other, an inner diameter of said plastic sleeve being smaller than a sum of the diameter of said guide bearing and the diameter of said eccentric.

2. The compressor as defined in claim 1, including an eccentric bearing (25) for supporting said eccentric in said displacement element, said element having a pocket bore (26), at least one rubber elastic O-ring (27) being positioned in said element for supporting said eccentric bearing at a cylindrical wall of said pocket bore.

3. The compressor as defined in claim 1, wherein four said guides are provided along the periphery of said displacement element.

4. The compressor as defined in claim 1, wherein each guide bearing is formed as a ball bearing having an inner ring (331), an outer ring (332) and balls running therebetween, and a bearing bolt (34) supporting said inner ring thereon, said outer ring (332) being in engagement with an inner wall of said plastic sleeve (35), said bearing bolts of said guide bearings being screwed in said second housing portions and being positioned at an equal radial distance from a central axis of said second housing portion.

5. The compressor as defined in claim 1, wherein said displacement element has a back side facing said second housing portion and coated with a plastic layer.

6. The compressor as defined in claim 5, wherein said plastic layer is PTFE film glued to said back side.

7. The compressor as defined in claim 1, wherein said displacement element has an axial passage (40), said second housing portion being spaced from a back side of said displacement element which faces said second housing portion to from a play (38) therebetween, said axial passage connecting said inner high pressure chamber (21) with said play.

8. The compressor as defined in claim 7, wherein said drive shaft is sealed against said second housing portion by a sealing means.

9. The compressor as defined in claim 8, wherein said sealing means comprises a slide ring device (47) including a plastic ring (48) mounted on said drive shaft (23) with interposition of an O-ring (49), a safety ring (51) positioned on said drive shaft, and a disc spring (50) which presses said plastic ring (48) to said safety ring.

* * * * *